US008245364B2

(12) United States Patent
Ackerman et al.

(10) Patent No.: US 8,245,364 B2
(45) Date of Patent: Aug. 21, 2012

(54) CLOSURE MECHANISM HAVING INTERNAL PROJECTIONS TO DECREASE SLIDER PULL-OFF

(75) Inventors: Bryan L. Ackerman, Freeland, MI (US); James C. Pawloski, Bay City, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 574 days.

(21) Appl. No.: 12/417,853

(22) Filed: Apr. 3, 2009

(65) Prior Publication Data

US 2009/0265898 A1 Oct. 29, 2009

Related U.S. Application Data

(60) Provisional application No. 61/047,247, filed on Apr. 23, 2008.

(51) Int. Cl.
*B65D 33/16* (2006.01)

(52) U.S. Cl. ..... 24/400; 24/399; 24/572.1; 383/63; 383/64

(58) Field of Classification Search ..... 24/399, 24/400, 572.1, 30.5 R, 584.1, 585.1, 585.11, 24/585.12, DIG. 50; 383/63, 64
See application file for complete search history.

(56) References Cited

U.S. PATENT DOCUMENTS

| | | | | |
|---|---|---|---|---|
| 3,173,184 | A | 3/1965 | Ausnit | |
| 3,220,076 | A * | 11/1965 | Ausnit et al. | 24/399 |
| 3,426,396 | A | 2/1969 | Laguerre | |
| 4,561,109 | A | 12/1985 | Herrington | |
| 4,615,082 | A | 10/1986 | Horlacher | |
| 5,007,142 | A | 4/1991 | Herrington | |
| 5,010,627 | A | 4/1991 | Herrington | |
| 5,111,643 | A | 5/1992 | Hobock | |
| 5,283,932 | A | 2/1994 | Richardson | |
| 5,638,586 | A | 6/1997 | Malin | |
| 5,664,299 | A * | 9/1997 | Porchia et al. | 24/400 |
| 5,722,128 | A * | 3/1998 | Toney et al. | 24/400 |
| 5,836,056 | A | 11/1998 | Porchia | |
| 5,871,281 | A | 2/1999 | Stolmeier | |
| 5,956,815 | A * | 9/1999 | O'Connor et al. | 24/30.5 R |
| 6,092,267 | A | 7/2000 | Covi | |
| 6,178,602 | B1 * | 1/2001 | Burke et al. | 24/30.5 R |
| 6,220,754 | B1 | 4/2001 | Stiglic | |
| 6,257,763 | B1 * | 7/2001 | Stolmeier et al. | 383/5 |
| 6,290,391 | B1 | 9/2001 | Buchman | |
| 6,290,393 | B1 * | 9/2001 | Tomic | 383/210.1 |
| 6,402,375 | B1 * | 6/2002 | Schreiter et al. | 383/64 |
| 6,490,769 | B2 | 12/2002 | Siegel | |
| D469,721 | S | 2/2003 | Buchman | |
| 6,524,002 | B2 * | 2/2003 | Tomic | 383/64 |
| 6,526,632 | B1 | 3/2003 | Blythe | |
| 6,595,689 | B1 | 7/2003 | Borchardt | |

(Continued)

*Primary Examiner* — Robert J Sandy
*Assistant Examiner* — Tyler Johnson

(57) ABSTRACT

A slider actuated closure mechanism includes internal projections that extend from interior sides of the closure elements and retention members that extend from exterior sides of the closure elements. A slider is disposed over the first and second closure elements and includes first and second sidewalls each including a shoulder inwardly extending from a distal end thereof. When the slider is disposed over the first and second closure elements, the first sidewall and the first closure element are minimally horizontally separated by a distance $d_1$, the second sidewall and the second closure element are minimally horizontally separated by a distance $d_2$, and the internal projections are horizontally separated by a distance $d_3$. The sum of the distances $d_1$, $d_2$, and $d_3$ equals a total non-zero distance, $d_t$, that is less than a length that each of the shoulders inwardly extends from the respective first and second sidewalls.

19 Claims, 8 Drawing Sheets

U.S. PATENT DOCUMENTS 6,609,827 B2 8/2003 Bois
D479,467 S 9/2003 Buchman
6,611,996 B2 9/2003 Blythe
6,632,021 B2 10/2003 Bois
6,651,297 B1 * 11/2003 Borchardt ..... 24/399
6,691,375 B1 2/2004 Savicki
6,733,178 B2 5/2004 Bois
6,755,569 B2 6/2004 Bois
6,761,481 B1 7/2004 Bois
6,840,675 B2 * 1/2005 Knight ..... 383/64
6,843,600 B2 * 1/2005 Tilman et al. ..... 383/5
6,874,205 B1 4/2005 Savicki
6,883,210 B1 4/2005 Savicki
6,899,460 B2 * 5/2005 Turvey et al. ..... 383/33
6,902,321 B2 6/2005 Bois
6,915,546 B2 7/2005 Kasai
6,918,230 B2 * 7/2005 Thieman ..... 53/412
6,939,040 B2 * 9/2005 Schneider ..... 383/61.2
6,948,849 B2 9/2005 Schreiter
6,962,440 B2 11/2005 Fenzl
6,981,299 B2 * 1/2006 Savicki, Sr. ..... 24/399
6,996,879 B1 * 2/2006 Savicki ..... 24/30.5 R
7,029,178 B2 * 4/2006 Gzybowski ..... 383/64
7,052,181 B2 * 5/2006 Smith et al. ..... 383/64
7,056,417 B2 6/2006 Haws
7,090,397 B2 * 8/2006 Stolmeier ..... 383/64
7,134,192 B1 11/2006 Savicki
7,140,772 B2 11/2006 Bois
7,182,514 B2 * 2/2007 Schreiter ..... 383/64
7,254,873 B2 * 8/2007 Stolmeier et al. ..... 24/400
7,364,361 B2 * 4/2008 Turvey et al. ..... 383/33
7,377,015 B2 5/2008 Long
7,494,280 B2 * 2/2009 Gzybowski ..... 383/64
7,600,300 B2 * 10/2009 Russell et al. ..... 24/400
2002/0064321 A1 * 5/2002 Schreiter ..... 383/64
2004/0022461 A1 * 2/2004 Schreiter ..... 383/64
2004/0064923 A1 * 4/2004 Gzybowski ..... 24/399
2004/0074058 A1 * 4/2004 Thieman ..... 24/399
2005/0084183 A1 4/2005 Ausnit
2005/0157957 A1 * 7/2005 Turvey et al. ..... 383/33
2005/0281492 A1 * 12/2005 Turvey et al. ..... 383/64
2006/0029301 A1 * 2/2006 Schreiter ..... 383/64
2006/0210203 A1 * 9/2006 Gzybowski ..... 383/64
2006/0269170 A1 11/2006 Chaturvedi
2007/0000098 A1 1/2007 Ausnit
2007/0094850 A1 5/2007 Hui
2007/0193000 A1 8/2007 Cameron
2007/0245529 A1 * 10/2007 Stewart ..... 24/415
2007/0280564 A1 * 12/2007 Lyon et al. ..... 383/69
2008/0172842 A1 7/2008 Blythe
2008/0172846 A1 * 7/2008 Russell et al. ..... 24/400
2008/0285894 A1 * 11/2008 Stolmeier ..... 383/64
2009/0142007 A1 * 6/2009 Bois ..... 383/64
2009/0148080 A1 * 6/2009 Gzybowski ..... 383/64

* cited by examiner

CLOSURE MECHANISM HAVING INTERNAL PROJECTIONS TO DECREASE SLIDER PULL-OFF

CROSS REFERENCE TO RELATED APPLICATIONS

This application claims the benefit of U.S. Provisional Patent Application No. 61/047,247, filed Apr. 23, 2008, which is incorporated herein by reference in its entirety.

REFERENCE REGARDING FEDERALLY SPONSORED RESEARCH OR DEVELOPMENT

Not applicable.

SEQUENTIAL LISTING

Not applicable.

FIELD OF THE INVENTION

The present invention generally relates to a closure mechanism, and more particularly, to a slider actuated closure mechanism including features that decrease slider pull-off.

BACKGROUND

Slider actuated closure mechanisms are commonly used to seal containers, for example, flexible pouches. In such a closure mechanism, a slider is typically disposed in a straddling relationship over interlocking elements of the closure mechanism. Motion of the slider in a first direction occludes the closure mechanism and motion of the slider in a second direction deoccludes the closure mechanism.

One such slider actuated closure mechanism has a pair of closure elements, each having a lateral extension disposed along a top edge thereof. Inner surfaces of the lateral extensions contact one another when the closure elements are occluded, giving the occluded closure mechanism a T-shape. A slider is retained over and in contact with outer surfaces of the lateral extensions.

Another slide actuated closure mechanism has first and second closure elements having respective first and second bases, wherein the first base has a longer cross section than does the second base. The first base has a first perpendicular projection inwardly extending from a bottom end thereof, and the second closure element has a second perpendicular projection inwardly extending from a bottom end thereof. First and second sealing flanges downwardly extend from the respective first and second perpendicular projections and are inwardly offset from the respective first and second bases, to define a shoulder at the bottom end of each base. In an occluded state, a distal end of the first projection abuts the second base and the second projection extends under the first projection such that a distal end of the second projection abuts the first sealing flange. A slider has first and second sidewalls, wherein the first sidewall has a longer cross section than the second sidewall, and each of the first and second sidewalls has an inwardly extending member on a distal end thereof. The inwardly extending members extend over the shoulders to retain the slider on closure elements.

Yet another slider actuated closure mechanism has first and second closure elements having respective first and second bases of equal cross-sectional length. First and second projections inwardly extend from a bottom end of the respective first and second bases. First and second sealing flanges downwardly extend from inner ends of the respective first and second projections, to define a shoulder at the bottom end of each base. Inwardly extending members disposed at distal ends of sidewalls of a slider extend over the shoulders to retain the slider on the closure elements.

Still another slider actuated closure mechanism has at least one set of interlocking profiles and a leakproofing means disposed on a product side of the interlocking profiles. A slider is retained on closure elements of the closure mechanism by rails that fit into corresponding grooves. The rails are disposed on the closure elements and fit into grooves in the slider, or the rails are disposed on the slider and fit into grooves in the closure elements. The slider is also retained on the closure elements by inwardly extending members disposed on distal ends of sidewalls of the slider, wherein the inwardly extending members are engaged by bottom portions of the closure elements to hold the slider thereon. The leakproofing means has members that inwardly extend from each closure element to form a seal against one another or against a surface of the opposite closure element when the closure mechanism is occluded.

Yet a further slider actuated closure mechanism has first and second closure elements having respective first and second bases, wherein each of the first and second bases has a flange that extends upwardly therefrom. First and second feet are disposed on bottom ends of the respective first and second bases. Each of the first and second feet has a long side extending inwardly and a short side extending outwardly from each respective base. A sealing flange downwardly extends from each of the feet. A slider is retained over the closure elements by the outwardly extending short sides of the feet. In an occluded state, the feet are disposed in a staggered fashion, such that the long side of the first foot inwardly extends above the second foot, and the long side of the second foot inwardly extends under the first foot.

A still further slider actuated closure mechanism has a first flange that upwardly and outwardly extends at about a 45 degree angle from a top end of a first closure element. A second flange extends downwardly and outwardly at about a 45 degree angle from a middle portion of a second closure element. A perpendicular projection extends from each of the first and second closure elements proximate to a bottom end thereof, wherein the perpendicular projections are disposed directly opposite to one another. A sealing flange extends from the bottom end of each of the first and second closure elements and is offset from an outer surface thereof to form a shoulder thereon. A slider is retained on the shoulders of the closure elements by an inwardly extending member on a bottom end of each sidewall of the slider. The slider also has a groove in each sidewall to accommodate the first and second flanges, wherein the shape of each groove varies across the slider, such that moving the slider applies a force to the first and second flanges to disengage the closure elements.

Sill another slider actuated closure mechanism has first and second closure elements, wherein each closure element is attached at an outer surface thereof to an inner surface of respective first and second flange elements. Each of the first and second closure elements has an inwardly projecting member disposed at a bottom end thereof. Each inwardly projecting member downwardly extends at about a 45 degree angle. Each of the first and second flange elements has an outwardly extending protrusion thereon, wherein each outwardly extending protrusion is disposed just above each of the inwardly projecting members. A slider has an inwardly projecting arm disposed on a bottom end of each sidewall thereof, wherein the inwardly projecting arms extend over the outwardly extending protrusions to retain the slider on the closure elements.

SUMMARY

In one aspect of the present invention, a closure mechanism comprises a first closure element including a first base and a first interlocking member projecting inwardly from an internal side of the first base. A first projection extends from the internal side of the first base, a first retention member extends opposite to the first projection from an external side of the first base, and a first sealing flange extends downwardly from the first base below the first projection. A second closure element includes a second base, a second interlocking member that projects inwardly from an internal side of the second base in opposing relation to the first interlocking member, and a second sealing flange that extends downwardly from the second base. A slider is disposed over the first and second closure elements for occluding and deoccluding the first and second closure elements. The slider includes first and second sidewalls depending downwardly from a top wall and has a first shoulder extending inwardly from a distal end of the first sidewall and disposed below the retention member. A first horizontal distance $d_1$ is the smallest horizontally measured distance between the slider and the first closure element and a second horizontal distance $d_2$ is the smallest horizontally measured distance between the slider and the second closure element. A third horizontal distance $d_3$ is a horizontally measured distance between the first projection and the second closure element, and the sum of the distances $d_1$, $d_2$, and $d_3$ equals a total non-zero distance $d_t$ that is less than a length that the first shoulder inwardly extends from the first sidewall.

In another aspect of the present invention, a closure mechanism includes a first closure element having a first interlocking member that extends from an interior side of a first base thereof and a second closure element having a second interlocking member that extends from an interior side of a second base thereof, and in an occluded state, releasably interlocks with the first interlocking member. A first projection extends from the interior side of the first base spaced from the first interlocking member on a product side thereof and a first retention member extends directly opposite to the first projection from an exterior side of the first base. A second retention member extends from an exterior side of the second base. A first sealing flange extends downwardly from the first base below the first retention member and a second sealing flange extends downwardly from the second base below the second retention member. A slider is mounted over the first and second closure elements. The slider includes a first sidewall vertically depending from a top wall, the first sidewall having a first shoulder inwardly extending from a distal end thereof and horizontally past a distal end of the first retention member. The slider includes a second sidewall vertically depending from the top wall, the second sidewall having a second shoulder inwardly extending from a distal end thereof and horizontally past a distal end of the second retention member. The first sidewall and a portion of the first closure element are minimally horizontally separated by a distance $d_1$, and the slider and a portion of the second closure element are minimally horizontally separated by a distance $d_2$. The distal end of the first projection and the second closure element are horizontally separated by a distance $d_3$, and the sum of the distances $d_1$, $d_2$ and $d_3$ equals a total distance $d_t$, that is less than a length that a shorter of the first and second shoulders horizontally extends from the respective first and second sidewalls, to inhibit the slider from disengaging from the first and second closure elements.

In a further aspect of the present invention, a closure mechanism comprises a first closure element including first and second hooked closure profiles extending from an internal side of a first base thereof. A first projection has an end portion that extends from the internal side of the first base and is spaced from the first and second closure profiles on a product side thereof. A first sealing flange downwardly extends from the first base below the first projection. A second closure element includes third and fourth hooked closure profiles that extend from an internal side of a second base thereof and, in an occluded state, releasably interlock with the first and second closure profiles, respectively. A second projection has an end portion that extends from the internal side of the second base and is spaced from the third and fourth closure profiles on a product side thereof and directly opposite to the first projection. A second sealing flange downwardly extends from the second base below the second projection. A slider is disposed over the first and second bases. The slider includes a first side wall vertically depending from a top wall, the first side wall having a first shoulder extending from a distal end thereof. The slider includes a second side wall vertically depending from the top wall, the second side wall having a second shoulder extending from a distal end thereof. A first horizontal distance $d_1$ is the smallest horizontally measured distance between the slider and the first closure element and a second horizontal distance $d_2$ is the smallest horizontally measured distance between the slider and the second closure element. A third horizontal distance $d_3$ is a horizontally measured distance between the end portions of the first and second projections, and the sum of the distances $d_1$, $d_2$, and $d_3$ equals a total non-zero distance $d_t$, that is less than a length that each of the first and second shoulders inwardly extends from the respective first and second sidewalls, to prevent the slider from disengaging from the first and second closure elements.

BRIEF DESCRIPTION OF THE DRAWINGS

Other aspects and advantages of the present disclosure will become apparent upon consideration of the following detailed description, wherein similar structures have similar reference numbers.

DETAILED DESCRIPTION

Figure 1:
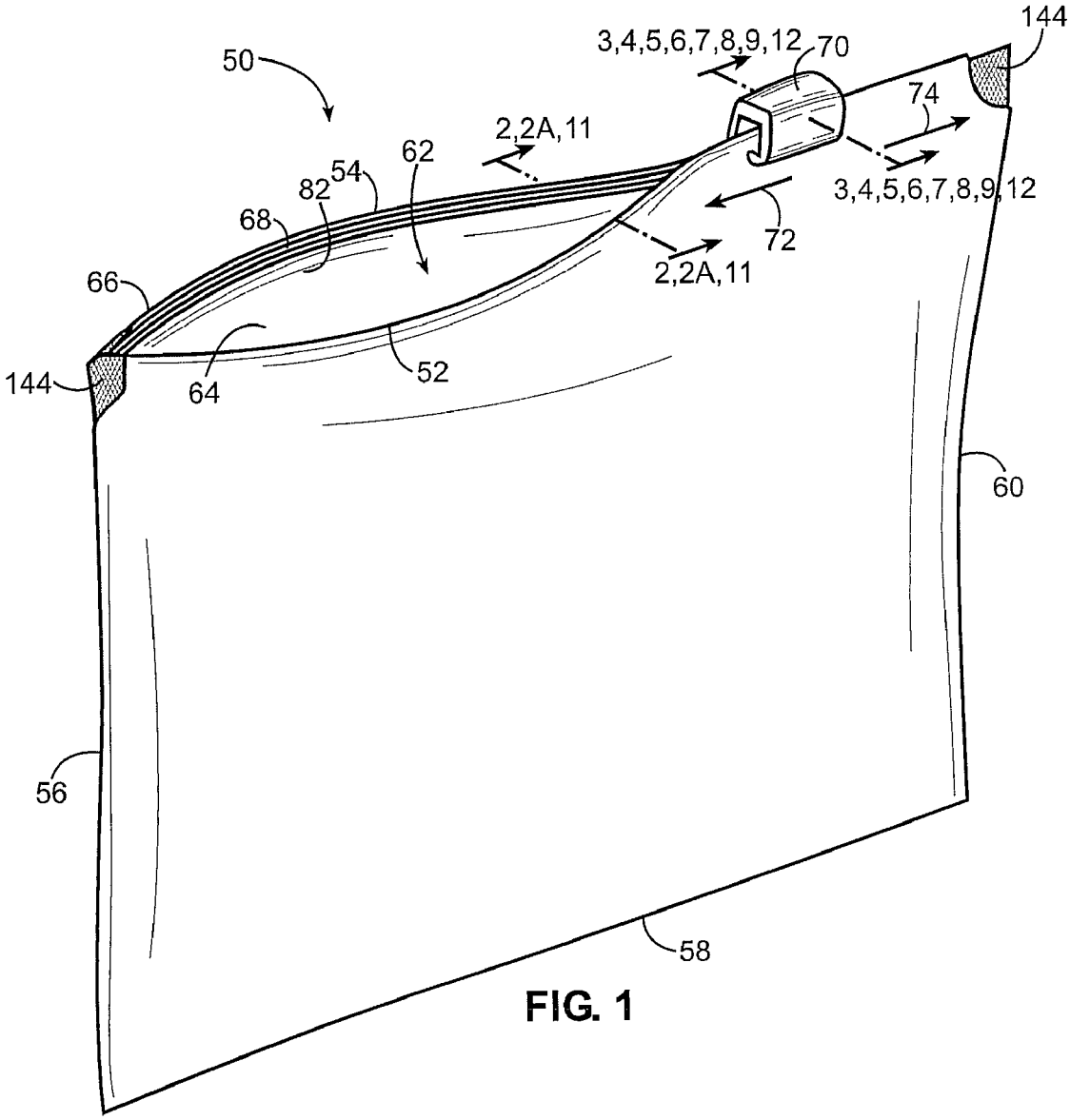
FIG. 1 is an isometric view of a pouch having a slider actuated closure mechanism.

The present disclosure is directed to a reclosable pouch having a slider actuated closer mechanism that includes features that assist in retaining the slider on the closure mechanism. While specific embodiments are discussed herein, it is understood that the present disclosure is to be considered only as an exemplification of the principles of the invention. For example, when the disclosure is illustrated herein with particular reference to two hooked closure profiles disposed on each of two closure elements, it will be understood that any number of hooked closure profiles, including one or more, can be used if desired. Also, when the disclosure is illustrated herein with one interior projection disposed on each of two closure elements, it will be understood that any number of interior projections may be used on each of the closure elements, for example, one or more interior projections disposed on one or both of the closure elements, or only one interior projection disposed on one of the closure elements. Similarly, when the disclosure is illustrated herein with one retention member disposed on each of two closure elements, it will be understood that the retention member may be absent from one closure element or that multiple retention members may be disposed on one or both of the closure elements. Therefore, the present disclosure is not intended to limit the disclosure to the embodiments illustrated.

In accordance with one aspect of this disclosure, a slider actuated closure mechanism includes a first closure element having one or more hooked elements, for example, first and second hooked closure profiles extending from an interior side of a first base thereof, and a second closure element having one or more hooked elements, for example, third and fourth hooked closure profiles that extend from an interior side of a second base thereof and, in an occluded state, releasably interlock with the first and second closure profiles, respectively. Illustratively, a first projection extends from the interior side of the first base and is spaced from the first and second closure profiles on a product side thereof. A first retention member extends directly opposite to the first projection from an exterior side of the first base. A second projection extends from the interior side of the second base and is spaced from the third and fourth closure profiles on a product side thereof and directly opposite to the first projection. A second retention member extends directly opposite to the second projection from an exterior side of the second base. A slider is mounted over the first and second closure elements and includes a first sidewall vertically depending from a top wall, the first sidewall having a first shoulder inwardly extending from a distal end thereof and horizontally past a distal end of the first retention member. The slider includes a second sidewall vertically depending from the top wall, the second sidewall having a second shoulder inwardly extending from a distal end thereof and horizontally past a distal end of the second retention member. In an illustrative mounted state, the first sidewall and a portion of the first closure element are minimally horizontally separated by a distance $d_1$, the second sidewall and a portion of the second closure element are minimally by horizontally separated by a distance $d_2$, the distal ends of the first and second projections are horizontally separated by a distance $d_3$, and the sum of the distances $d_1$, $d_2$, and $d_3$ equals a total distance $d_t$, that is less than a length that a shorter of the first and second shoulders horizontally extends from the respective first and second sidewalls to inhibit the slider from disengaging from the first and second closure elements.

FIG. 1 illustrates a reclosable pouch 50 having a first sidewall 52 and a second sidewall 54 that are connected by, for example, folding, heat sealing, and/or an adhesive, along three peripheral edges 56, 58, 60, to define an interior space 62 between the first and second sidewalls 52, 54, and an opening 64 along a top edge 66 where the first and second sidewalls 52, 54 are not connected, so as to allow access to the interior space 62. A slider actuated closure mechanism 68 is disposed along the first and second sidewalls 52, 54 near the opening 64 and extends between the peripheral edge 56 and the peripheral edge 60 of the pouch 50, to allow the opening 64 to be repeatedly occluded and deoccluded, thereby respectively sealing and unsealing the opening 64. A slider 70 is straddlingly disposed over the slider actuated closure mechanism 68. Motion of the slider 70 in a first direction, as indicated by the arrow 72, occludes the closure mechanism 68, and motion of the slider 70 in a second direction, as indicated by the arrow 74, deoccludes the closure mechanism 68.

Figure 2:
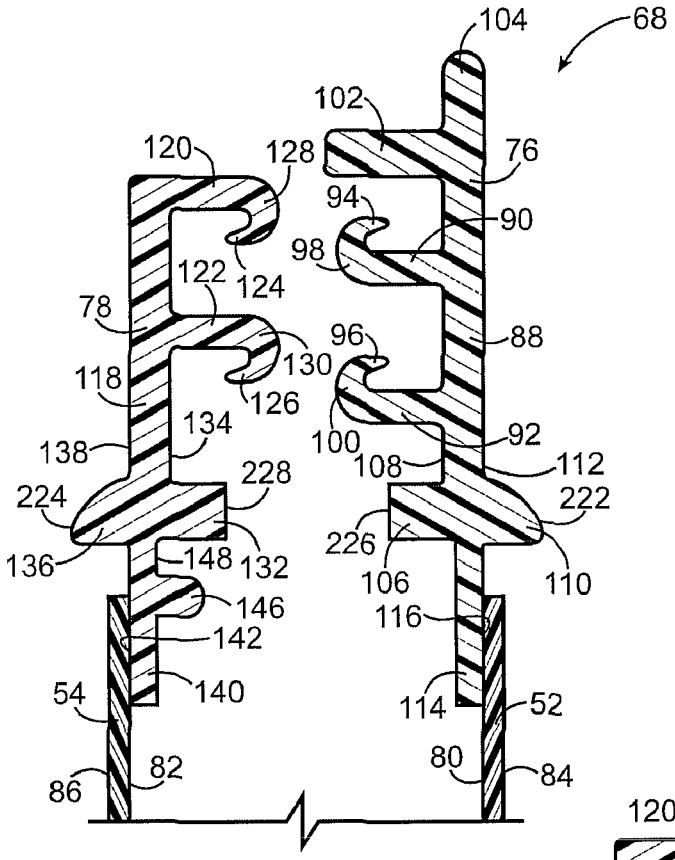
FIG. 2 is a cross-sectional view of an embodiment of closure elements of a slider actuated closure mechanism, taken generally along the lines 2-2 of FIG. 1, with portions behind the plane of the cross section omitted for clarity.

Referring to FIG. 2, in a first embodiment, the slider actuated closure mechanism 68 includes a first closure element 76 that releasably interlocks with an opposing second closure element 78. Illustratively, each of the closure elements 76, 78 has a substantially constant elongate cross-sectional profile that extends longitudinally between the peripheral edge 56 and the peripheral edge 60 of the pouch 50, to form a continuous seal therealong when fully interlocked with the opposing closure element. In one embodiment, the first closure element 76 is disposed on an interior surface 80 of the first sidewall 52 and the second closure element 78 is disposed along an interior surface 82 of the second sidewall 54.

In other embodiments, the first and second sidewalls 52, 54, respectively, or one of the first and second closure elements 76, 78 may be attached to one of the interior surfaces 80, 82 of the respective first and second sidewalls 52, 54, and the other of the first and second closure elements 76, 78 may be attached to one of the exterior surfaces 84, 86 of the respective first and second sidewalls 52, 54. In further embodiments (see FIG. 2A), one or both of the first and second sidewalls 52, 54, may be integral with the respective first and second closure elements.

As best illustrated in FIG. 2, the first closure element 76 includes a first base 88 and first and second closure profiles 90, 92 extending from the first base 88. Each of the first and second closure profiles 90, 92 includes a hooked portion 94, 96 disposed at a respective distal end 98, 100 thereof. The first base 88 includes a stiffening member 102 extending therefrom above the first closure profile 90. The stiffening member 102 may be configured, for example, to provide additional rigidity to the first base 88. The first base 88 also includes an upward extension 104 above the stiffening member 102. The upward extension 104 may be configured, for example, to limit the vertical range of motion of the slider 70 when mounted on the first and second closure elements 76, 78.

A first interior projection 106 extends from an interior side 108 of the first base 88 and is disposed below the second closure profile 92. A first retention member 110 extends from an exterior side 112 of the first base 88 and is disposed directly opposite to the first interior projection 106. A first sealing flange 114 downwardly extends from the first base 88 below the first interior projection 106. The first closure element 76 may be attached to the first sidewall 52, for example, by attaching an exterior surface 116 of the first sealing flange 114 to the interior surface 80 of the first sidewall 52.

The second closure element 78 includes a second base 118, and third and fourth closure profiles 120, 122 extending from a second base 118. Each of the third and fourth closure profiles 120, 122 includes a hooked portion 124, 126 disposed at a respective distal end 128, 130 thereof. The first and second closure profiles 90, 92 interlockingly engage with the third and fourth closure profiles 120, 122, respectively, when the first and second closure elements 76, 78 are in an occluded state.

A second interior projection 132 extends from an interior side of the second base 118 and is disposed below the fourth closure profile 122 and directly opposite to the first interior projection 106. A second retention member 136 extends from an exterior side 138 of the second base 118 and is disposed directly opposite to the second interior projection 132. A second sealing flange 140 downwardly extends from the second base 118 below the second interior projection 132. The second closure element 78 may be attached to the second sidewall 54, for example, by attaching an exterior surface 142 of the second sealing flange 140 to the interior surface 82 of the second sidewall 54.

Figure 2A:
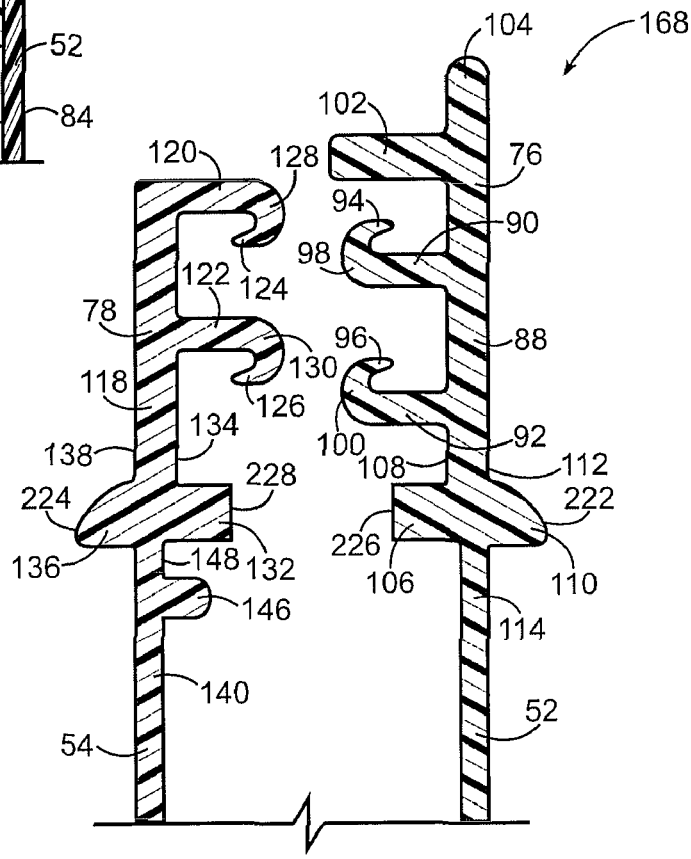
FIG. 2A is a cross-sectional view of another embodiment of closure elements of a slider actuated closure mechanism, taken generally along the lines 2A-2A of FIG. 1, with portions behind the plane of the cross section omitted for clarity.

FIG. 2A depicts another embodiment of a slider actuated closure mechanism 168 that is similar to the embodiment shown in FIG. 2, except for the following differences. In this embodiment, the first closure element 76 is integral with the first sidewall 52 and the second closure element 78 is integral with the second sidewall 54. The first sealing flange 114 in this embodiment may have a thickness that is the same as or different than the thickness of the first sidewall 52, and the second sealing flange 140 may have thickness that is the same as or different than the thickness of the second sidewall 54.

Figure 4:
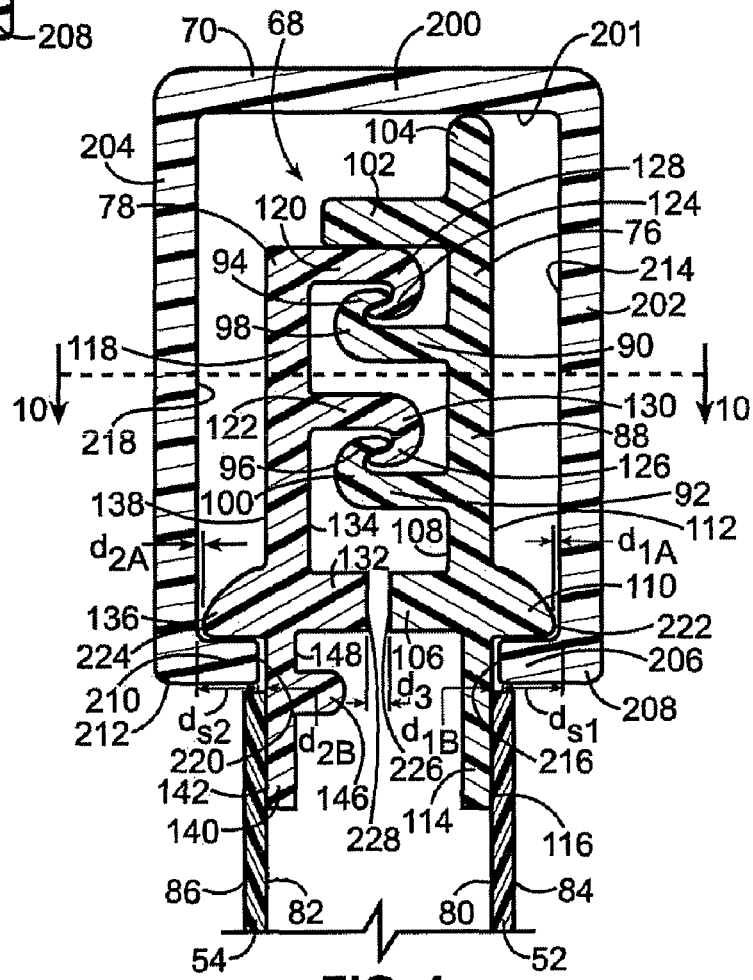
FIG. 4 is a cross-sectional view of the slider of FIG. 3 mounted on the closure elements of FIG. 2, taken generally along the lines 4-4 of FIG. 1, with portions behind the plane of the cross section omitted for clarity.

Referring now to FIGS. 1 and 2, ends 144 (shown in FIG. 1) of the slider actuated closure mechanism 68 may be sealed at the peripheral edges 56 and 60 by, for example, crushing and/or application of heat. However, in some instances (not shown), when the first interior projection 106 and the first sealing flange 114 are respectively crushed against the second interior projection 132 and the second sealing flange 140, the bulk of the material within the first and second interior projections 106, 132 may result in incomplete sealing of the ends 144 due to a gap (not shown) that remains uncrushed between the first and second sealing flanges 114, 140. To alleviate this incomplete crushing and to allow for a smaller crushing force to be applied to the first and second sealing flanges 114, 140, an optional material reservoir protrusion 146 (shown in FIG. 2A) may be provided on one or both interior surfaces of the first and second sealing flanges 114, 140. For example, the second closure element 78 may include the material reservoir protrusion 146 on an interior surface 148 of the second sealing flange 140, as shown in FIGS. 2A and 4. The material reservoir protrusion 146 may also be provided as a downward extension of an interior projection, for example, one or both of the first and second interior projections 106, 132. The material reservoir protrusion 146 provides, for example, extra sealing material to fill the uncrushed gap that may form beneath the first and second interior projections 106, 132 when the first and second closure elements 76, 78 are crushed to form a seal at the ends 144 of the slider actuated closure mechanism 68.

The material reservoir protrusion 146 may be made of a material that is the same as or different from the rest of the first and second closure element 76, 78. For example, the material reservoir protrusion 146 may be made of a material that has a lower melting temperature than the rest of the first and second closure elements 76, 78. A lower melting temperature for the material reservoir protrusion 146 may further facilitate filling of the gap (not shown) that may remain uncrushed between the first and second sealing FIGS. 114, 140, and may further allow for a smaller crushing force to be applied to the first and second sealing flanges 114, 140. Regardless of the material used, the material reservoir protrusion 146 may be independently added to the rest of the first and second closure elements 76, 78, for example, by independent extrusion thereon, or may be integral with the rest of the first and second closure elements 76, 78, for example, by coextrusion therewith.

Figure 3:
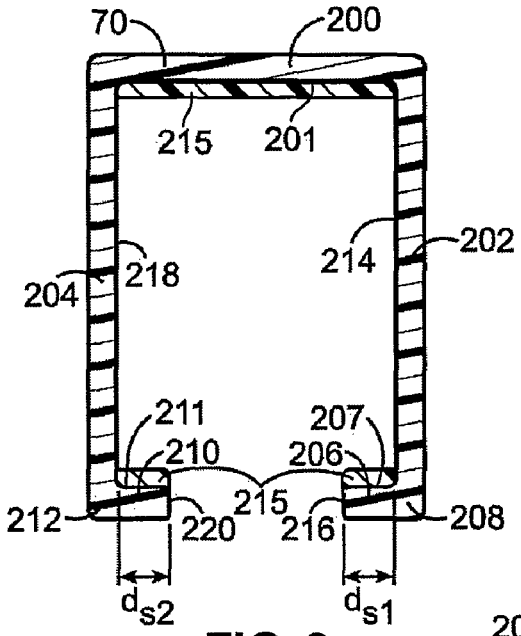
FIG. 3 is a cross-sectional view of an embodiment of a slider, taken generally along the lines 3-3 of FIG. 1, with portions behind the plane of the cross section omitted for clarity.

Referring now to FIG. 3, the slider 70 includes a top wall 200 that has a top interior surface 201 from which vertically depend first and second sidewalls 202, 204. The first sidewall 202 has a first shoulder 206 disposed at a distal end 208 thereof, and the second sidewall 204 has a second shoulder 210 disposed at a distal end 212 thereof. The first shoulder 206 includes a first shoulder interior surface 207 and extends a first shoulder distance, $d_{s1}$, measured from a first sidewall interior surface 214 to a distal end 216 of the first shoulder 206. The second shoulder 210 includes a second shoulder interior surface 211 and extends a second shoulder distance, $d_{s2}$, measured from a second sidewall interior surface 218 to a distal end 220 of the second shoulder 210. In this embodiment, $d_{s1}$ and $d_{s2}$ are non-zero values.

Illustratively referring to FIG. 4, the slider 70 is straddlingly disposed over the first and second closure mechanisms 76, 78, where the first and second shoulders 206, 210 are respectively engaged by the first and second retention members 110, 136. In particular, the distal end 216 of the first shoulder 206 extends inwardly and horizontally past a distal end 222 of the first retention member 110, and the distal end 220 of the second shoulder 210 extends inwardly and horizontally past a distal end 224 of the second retention member 136. When the slider 70 is mounted on the first and second closure elements 76, 78, the slider 70 has a portion or an extension that is horizontally spaced a first minimum horizontal distance, $d_1$, from the first closure element 76. As seen in FIG. 4, in this embodiment, the first minimum horizontal distance, $d_1$, is determined to be the smallest horizontally measured distance between the slider 70 and the first closure element 76. In this case, a horizontal measurement, $d_{1A}$, may be taken from the first sidewall interior surface 214 to the distal end 222 of the first retention member 110. Another horizontal measurement, $d_{1B}$, may be taken from the distal end 216 of the first shoulder 206 to the exterior surface 116 of the first sealing flange 114. If the values of $d_{1A}$ and $d_{1B}$ are different, the smaller value is the first minimum horizontal distance $d_1$. Horizontal measurements (not shown) may also be taken between other portions of the slider 70 and the first closure element 76. If other horizontal measurements are taken, the first minimum horizontal distance, $d_1$, is the smallest of all the horizontal measurements that are taken between portions or extensions of the first closure element 76 and portions or extensions of the slider 70.

Similarly, the slider 70 has a portion or an extension that is horizontally spaced a second minimum horizontal distance, $d_2$, from the second closure element 78. A horizontal measurement, $d_{2A}$, may be taken from the second sidewall interior surface 218 to the distal end 224 of the second retention member 136. Another horizontal measurement, $d_{2B}$, may be taken from the distal end 220 of the second shoulder 210 to the exterior surface 142 of the second sealing flange 140. The second minimum horizontal distance, $d_2$, is the smallest of all horizontal measurements, including, for example, $d_{2A}$ and $d_{2B}$, which may be taken between portions or extensions of the second closure element 78 and portions or extensions of the slider 70.

Referring to FIG. 4, each of the first and second minimum horizontal distances, $d_1$ and $d_2$, illustratively has a non-zero magnitude to allow the slider 70 to be moved by a user across the slider actuated closure mechanism 68, without requiring the application of excessive force to the slider 708, to overcome the static and/or dynamic friction between the slider 70 and the distal ends 222, 224 of the first and second retention members 110, 136. Further, static and/or dynamic friction between the slider 70 and the slider actuated closure mechanism 68 can be reduced if desired, for example, by lowering the coefficient of friction of opposing surfaces of potential contact of one or both of the slider 70 and the slider actuated closure mechanism 68. For example, in one embodiment, a lubricant, such as silicone grease, may be applied along an exterior surface of the slider actuated closure mechanism 68, for example, the distal ends 222, 224 of the first and second retention members, or to an interior surface of the slider 70, for example, the first and second sidewall interior surfaces 214, 218. In another embodiment, a portion or portions of the slider 70 may be manufactured from a material that has a low coefficient of friction with respect to the material of the slider actuated closure mechanism 68 to act as a lubricant for motion of the slider over the slider actuated closure mechanism. Alternatively, a portion or portions of the slider actuated closure mechanism 68 may be manufactured from a material that has a low coefficient of friction with respect to the material of the slider 70, or a portion or portions of both of the slider 70 and the slider actuated closure mechanism 68 may be made of materials that have a low coefficient of friction with regard to the opposing surfaces of potential contact. Illustratively, one or more of the interior surfaces 201, 207, 211, 214, or 218 of the slider 70, as shown in FIG. 3, may be manufactured of or may be coated with a material that has a low coefficient of friction, for example, a fluoropolymer material, such as polytetrafluoroethylene, which is a TEFLON® coating manufactured by DuPont and is well known for use as a lubricant to reduce friction between surfaces. In FIG. 3, each of the interior surfaces 201, 207, and 211 is illustrated as optionally including a pad of material 215, for example, polytetrafluoroethylene, that has a low coefficient of friction with regard to the opposing surfaces of potential contact attached thereto.

As best seen in FIG. 4, when the slider 70 is mounted on the first and second closure elements 76, 78, distal ends 226, 228 of the respective first and second interior projections 106, 132 are disposed directly opposite to one another. Corresponding points of potential contact on the first and second closure elements 76, 78 are horizontally separated by a third horizontal distance, $d_3$. In this embodiment, the third horizontal distance, $d_3$, is measured between the distal ends 226, 228 of the respective first and second interior projection 106, 132. The first and second minimum horizontal distances, $d_1$ and $d_2$, and the third horizontal distance, $d_3$, sum to a total distance, $d_t$. When the slider 70 is mounted on the first and second closure elements 76, 78, the total distance, $d_t$, represents the smallest total distance between the slider 70 and each of the first and second closure elements 76, 78.

An excessively large total distance, $d_t$, may allow distal ends 222, 224 of one or both of the respective first and second retention members 110, 136 to inwardly displace past the corresponding distal ends 216, 220 of the respective first and second shoulders 206, 210. Such inward displacement of one or both of the first and second retention members 110, 136 may allow the slider 70 to partially or to completely disengage from the slider actuated closure mechanism 68. For example, if the total distance, $d_t$, exceeds the larger of the first and second shoulder distances, $d_{s1}$ and $d_{s2}$, each of the first and second shoulders 206, 210 may disengage from the respective first and second retention members 110, 136, which may result in complete disengagement of the slider 70 from the slider actuated closure mechanism 68. In another example, if the total distance, $d_t$ is less than the larger of the first and second shoulder distances, $d_{s1}$ and $d_{s2}$, but is greater than the shorter of the first and second shoulder distances, $d_{s1}$ and $d_{s2}$, the shorter of the first and second shoulders 206, 210 may disengage from the respective first or second retention member 110, 136. The slider 70, thus partially disengaged from the slider actuated closure mechanism 68, but may be sufficiently upwardly displaced therefrom such that the slider 70 may not have the capacity to facilitate occlusion and/or deocclusion of the first and second closure elements 76, 78. In addition, partial disengagement of the slider 70 from the slider actuated closure mechanism 68 may result in undesirable deformation of the first and second closure elements 76, 78 caused by forced motion of the slider in the first or second directions 72, 74. Ultimately, such deformation of the first and second closure elements 76, 78 may cause the slider actuated closure mechanism 68 to become non-functional. However, if the total distance, $d_t$ is less than the smaller of $d_{s1}$ and $d_{s2}$, the slider 70 is inhibited from being disengaged from the slider actuated closure mechanism 68.

In the absence of any deformation of the slider 70 from a nominal shape, for example, as shown in FIG. 4, each of the distances, $d_1$, $d_2$, and $d_3$, may vary due to freedom of the first and second closure elements 76, 78 to laterally move within the slider 70. However, despite variances in the distances, $d_1$, $d_2$, and $d_3$, in the absence of deformation of the slider 70, the total distance, $d_t$, remains fixed. In a dynamic configuration, such as when the slider 70 is grasped by a user and moved along the first and second closure elements 76, 78, the first and second slider sidewalls 202, 204 may be inwardly deformed by the user. Such inward deformation of the sidewalls 202, 204 decreases the total distance, $d_t$, by decreasing one or more of the distances, $d_1$, $d_2$, and $d_3$. Therefore, inward deformation of the sidewalls 202, 204 due to user applied pressure thereto further inhibits the slider 70 from easily being disengaged from the first and second closure elements 76, 78.

Each of the first and second interior projections 106, 132 and each of the first and second retention members 110, 136 may be made of a material that is the same as or different from the rest of the first and second closure elements 76, 78. For example, the first and second interior projections 106, 132, may be made of a material that has a lower melting temperature than the rest of the first and second closure elements 76, 78. A lower melting temperature for the first and second interior projections 106, 132 may further facilitate filling of the gap (not shown) and that may remain uncrushed between the first and second sealing flanges 114, 140 and may further allow for a smaller crushing force to be applied to the first and second sealing flanges 114, 140. As another example, each of the first and second interior projections 106, 132 and the first and second retention members 110, 136 may be made of a material that is stronger, more rigid, or that may have other desirable enhanced physical characteristics in comparison to the rest of the first and second closure elements 76, 78. Illustratively, use of a material for the first and second interior projections 106, 132 and first and second retention members 110, 136 that is stronger than the rest of the first and second closure elements 76, 78 may further inhibit disengagement of the slider 70 from the first and second closure elements 76, 78. Regardless of the material used, the first and second interior projections 106, 132 and the first and second retention members 110, 136 may be independently added to the rest of the first and second closure elements 76, 78, for example, by independent extrusion thereon, or may be integral with the rest of the first and second closure elements 76, 78, for example, by coextrusion therewith.

Figure 5:
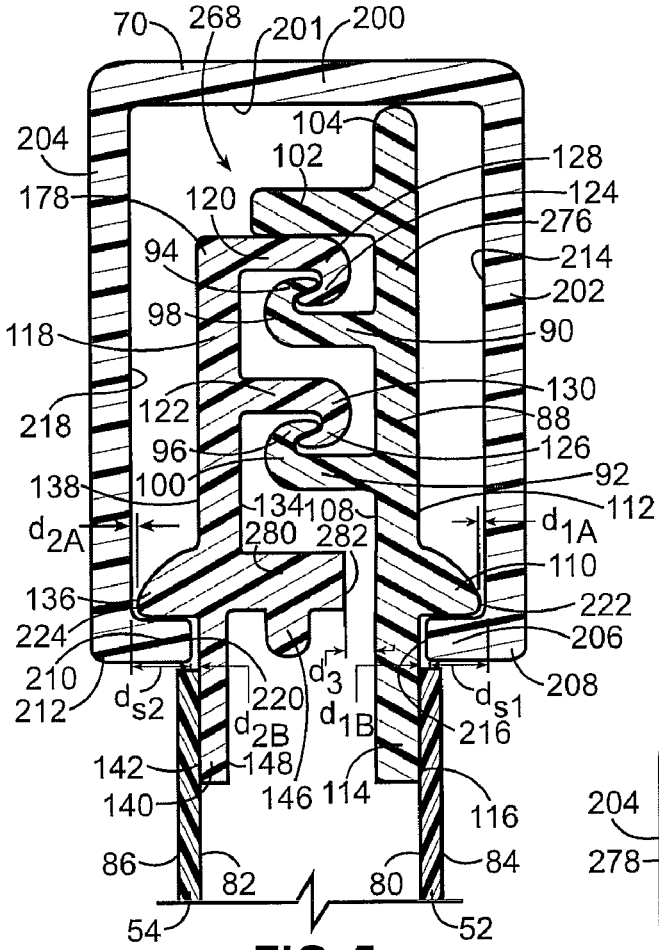
FIG. 5 is a cross-sectional view of the slider of FIG. 3 mounted on another embodiment of closure elements of the slider actuated closure mechanism, taken generally along the lines 5-5 of FIG. 1, with portions behind the plane of the cross section omitted for clarity.

In determining the total distance, $d_t$, other considerations, such as the ease of placing the slider 70 on the first and second closure elements 76, 78 during the manufacture thereof, or the ease of moving the slider along the first and second closure elements, may also influence the desired distances $d_1$, $d_2$, $d_3$, $d_{s1}$, and $d_{s2}$, including one or more of these distances having or approaching a zero or negative value. For example, other embodiments may lack components shown in the embodiment of FIG. 4, but may still achieve the desired effect of retaining the slider 70 on the first and second closure elements 76, 78. Illustratively, an embodiment shown in FIG. 5 is similar to the embodiment shown in FIG. 4 except for the following differences. A slider actuated closure mechanism 268 includes a first closure element 276, but an interior projection is absent. However, in this embodiment, a second closure element 178 includes an interior projection 280 that has been extended to compensate for the lack of an interior projection disposed on the first closure element 276. The material reservoir protrusion 146 downwardly extends from a bottom surface of the interior projection 280. In this embodiment, the third horizontal distance, $d_3$, is measured between the distal end 282 of the interior projection 280 and the interior side 108 of the first base 88. Similar to the embodiment of FIG. 4, in this embodiment, the distances, $d_1$, $d_2$, and $d_3$, sum to a total distance, $d_t$, which is less than the smaller of the first and second shoulder distances, $d_{s1}$ and $d_{s2}$.

Figure 6:
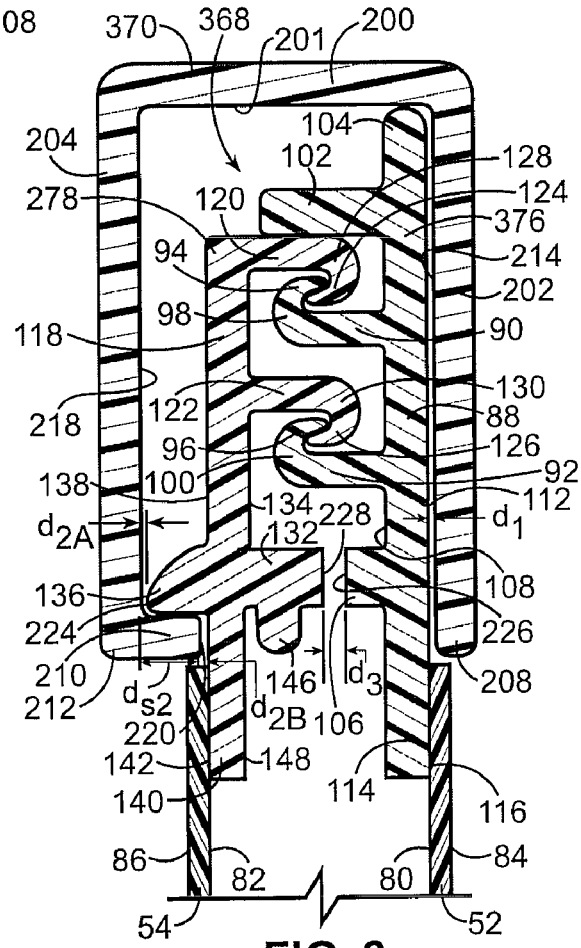
FIG. 6 is a cross-sectional view of another embodiment of a slider mounted on yet another embodiment of closure elements of the slider actuated closure mechanism, taken generally along the lines 6-6 of FIG. 1, with portions behind the plane of the cross section omitted for clarity.

Another embodiment illustrated in FIG. 6 includes a slider actuated closure mechanism 368 having a slider 370 mounted thereover. This embodiment is similar to the embodiment shown in FIG. 4 except for the following differences. A first closure element 376 lacks a retention member, but a second closure element 278 includes the retention member 136. The material reservoir protrusion 146 extends from a bottom surface of the second interior projection 132. The slider 370 has a first sidewall 202 that lacks a shoulder on the distal end 208 thereof. In this embodiment, the first minimum horizontal distance, $d_1$, is the smallest of all possible horizontal measurements taken between the first sidewall interior surface 214 and the exterior side 112 of the first base 88. The second minimum horizontal distance, $d_2$, is the smaller of the horizontal measurements, $d_{2A}$ and $d_{2B}$, as shown in FIG. 6, and the distances, $d_1$, $d_2$, and $d_3$, sum to a total distance, $d_t$, which, in this embodiment, is less than the second shoulder distance, $d_{s2}$.

Figure 7:
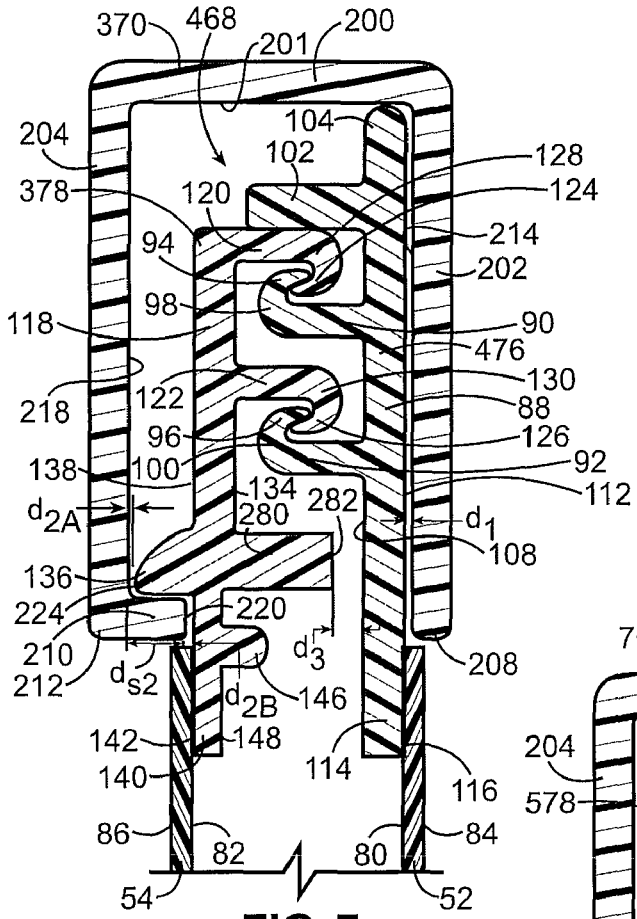
FIG. 7 is a cross-sectional view of the embodiment of the slider of FIG. 6 mounted on still another embodiment of closure elements of the slider actuated closure mechanism, taken generally along the lines 7-7 of FIG. 1, with portion behind the plane of the cross section omitted for clarity.

A further embodiment illustrated in FIG. 7 includes the slider 370 mounted over a slider actuated closure mechanism 468. This embodiment is similar to the embodiment shown in FIG. 6 except for the following differences. The slider actuated closure mechanism 468 includes a first closure element 476 that does not include an interior projection or a retention member. However, a second closure element 378 includes the interior projection 280 that has been extended to compensate for the lack of an interior projection disposed on the first closure element 476. In this embodiment, the third horizontal distance, $d_3$, is measured between the distal end 282 of the interior projection 280 and the interior side 108 of the first base 88. The distances, $d_1$, $d_2$, and $d_3$, sum to a total distance, $d_t$, which has a value less than the second shoulder distance, $d_{s2}$, to facilitate retention of the slider 370 on the slider actuated closure mechanism 468.

Figure 8:
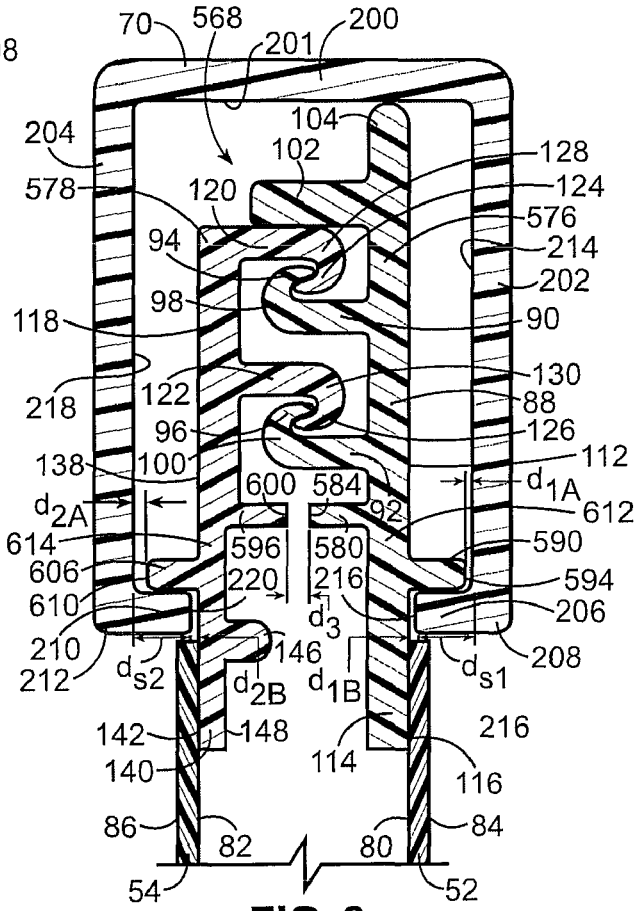
FIG. 8 is a cross-sectional view of the embodiment of the slider of FIG. 3 mounted on a further embodiment of closure elements of the slider actuated closure mechanism, taken generally along the lines 8-8 of FIG. 1, with portions behind the plane of the cross section omitted for clarity.

As illustrated in FIG. 8, another embodiment includes a slider actuated closure mechanism 568 that includes first and second closure elements 576, 578. This embodiment is similar to the embodiment shown in FIG. 4, except for the following differences. First, interior projection 580 extends from the interior side 108 of the first base 88 below the second closure profile 92 and terminates at distal end 584. Second interior projection 596 extends from the interior side 134 of the second base 118 and terminates at distal end 600. When the slider 70 is mounted on the closure mechanism 568, as shown in FIG. 8, the distal ends 584, 600 of the respective first and second interior projections 580, 596 are disposed directly opposite to each other.

First retention member 590 extends from the exterior side 112 of the first base 88 and is offset from the first interior projection 580. The first retention member 590 terminates at distal end 594. Second retention member 606 extends from the exterior side 138 of the second base 118 and is offset from the second interior projection 596. The second retention member 606 terminates at distal end 610.

In this embodiment, the horizontal distance, $d_1$, is the smaller of the horizontal measurements, $d_{1A}$ and $d_{1B}$, as shown in FIG. 8, where the horizontal measurement, $d_{1A}$, may be taken between the distal surface 594 of the first retention member 590 and the first sidewall interior surface 214, and the horizontal measurement, $d_{1B}$, may be taken between the distal surface 216 of the first shoulder 206 and the exterior surface 116 of the first sealing flange 114. Similarly, the second minimum horizontal distance, $d_2$, is the smaller of the horizontal measurements, $d_{2A}$ and $d_{2B}$, as shown in FIG. 8, where the horizontal measurement, $d_{2A}$, may be taken between the distal surface 610 of the second retention member 606 and the second sidewall interior surface 218, and the horizontal measurement, $d_{2B}$, may be taken between the distal surface 220 of the second shoulder 210 and the exterior surface 142 of the second sealing flange 140. Corresponding points of potential contact on the first and second closure elements 576, 578 are horizontally separated by the third horizontal distance, $d_3$. In this embodiment, the third horizontal distance, $d_3$, is measured between the distal ends 584, 600 of the respective first and second interior projection 580, 596. The distances, $d_1$, $d_2$, and $d_3$, sum to a total distance, $d_t$.

In this embodiment, each of the first and second closure elements 576, 578 may be configured to be substantially inflexible in first and second regions 612, 614, as shown in FIG. 8. The first region 612 is a region of the first base 88 disposed between the first retention member 590 and the first interior projection 580, and the second region 614 is a region of the base 118 disposed between the second retention member 606 and the second interior projection 596. For example, the first and second bases 88, 118 may be made of a substantially inflexible material as known to those of skill in the art and/or be made sufficiently thick in each of the regions 612, 614, to render the regions substantially inflexible in response to typical forces applied to the regions during normal use, but still allowing a slider, for example, the slider 70, to be installed over the slider actuated closure mechanism 56 during manufacture of the pouch 50. Illustratively, it is contemplated that the slider actuated closure mechanism 568 may be applied to the pouch 50, which may include a valve (not shown) through which a vacuum may be drawn to evacuate the interior space 62 of the pouch 50. A vacuum drawn on the interior space 62 of the pouch 50 may cause inward forces on the exterior surfaces 116, 142 of the respective first and second sealing flanges 114, 140. As the first and second bases 88, 118 of the respective first and second closure elements in this embodiment are substantially inflexible during normal use in the respective first and second regions, 612, 614, the first and second retention members 590, 606 are inhibited from inwardly cantilevering about the respective first and second interior projections 580, 596 in response to such inward forces. In this embodiment, the slider 70 is inhibited from being easily removed from the slider actuated closure mechanism 568 if the smaller of the first and second shoulder distances, $d_{s1}$ and $d_{s2}$, has a length greater than the total distance, $d_t$. Similarly, in an embodiment not shown, the first and second interior projections 580, 596 may each be located below the first and second retention members 590, 606, which may also allow for elimination of the material reservoir protrusion 146. In this embodiment, when the interior space 62 of the pouch 50 is placed under a vacuum, internal forces acting on the first and second sealing flanges 114, 140 are countered by contact of the first and second interior projections 580, 596, to inhibit the first and second sealing flanges from coming together, which may reduce the amount of inward flexing of the first and second closure elements 576, 578 during use.

Figure 9:
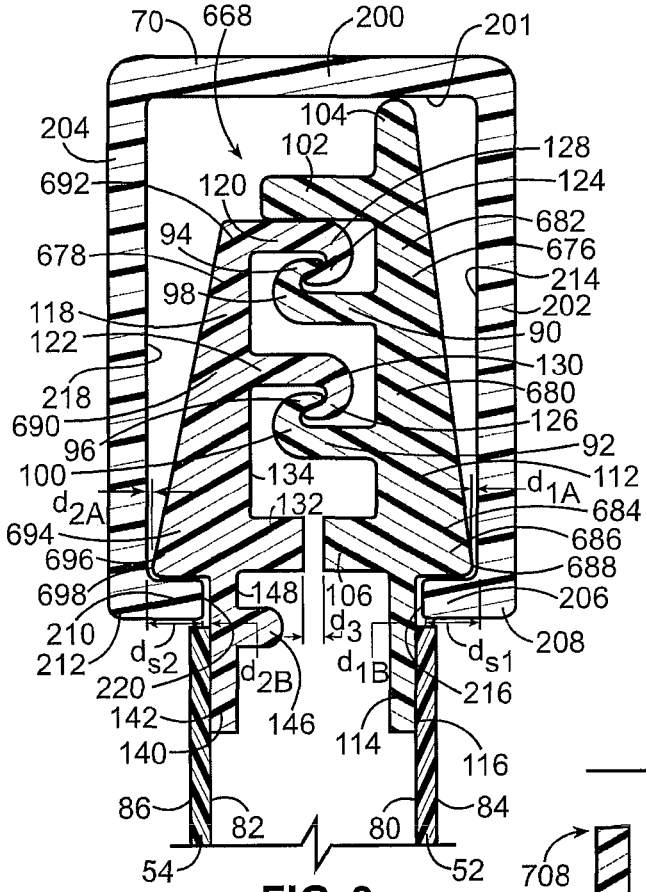
FIG. 9 is a cross-sectional view of the embodiment of the slider of FIG. 3 mounted on a still further embodiment of closure elements of the slider actuated closure mechanism, taken generally along the lines 9-9 of FIG. 1, with portions behind the plane of the cross section omitted for clarity.

In yet another embodiment, shown in FIG. 9, a slider actuated closure mechanism 668 includes first and second closure elements 676, 678. This embodiment is similar to the embodiment shown in FIG. 4 except for the following differences. In this embodiment, the first closure element 676 includes a first base 680 that increases in cross-sectional thickness from a thinner top end 682 to a thicker bottom end 684. A first retention member 686 is integral with the thicker bottom end 684 of the first base 680 and achieves maximum extension at a first distal end 688. Similarly, the second closure element 678 includes a second base 690 that increases in cross-sectional thickness from a thinner top end 692 to a thicker bottom end 694. A second retention member 696 is integral with the thicker bottom end 694 of the second base 690 and achieves maximum extension at a second distal end 698.

In this embodiment, and due to the shape of the first base 680 shown in FIG. 9, a horizontal measurement, $d_{1A}$, may be taken between the distal end 688 of the first retention member 686 and the first sidewall interior surface 214. A horizontal measurement, $d_{1B}$, may be taken between the distal surface 216 of the first shoulder 206 and the exterior surface 116 of the first sealing flange 114. The first minimum horizontal distance, $d_1$, is the smaller of the horizontal measurements, $d_{1A}$ and $d_{1B}$. Similarly, the second minimum horizontal distance, $d_2$, is the smaller of the horizontal measurements, $d_{1A}$ and $d_{1B}$. Similarly, the second minimum horizontal distance, $d_2$, is the smaller of horizontal measurements, $d_{2A}$ and $d_{2B}$, as illustrated in FIG. 9. The horizontal measurement, $d_{2A}$, may be taken from the second sidewall interior surface 218 to the distal end 698 of the second retention member 696, and the horizontal measurement, $d_{2B}$, may be taken from the distal surface 220 of the second shoulder 210 and the exterior surface 142 of the second sealing flange 140. The third horizontal distance, $d_3$, is measured between the distal ends 226, 228 of the respective first and second interior projections 106, 132. In this embodiment, the total distance, $d_t$, which is the sum of the distances, $d_1$, $d_2$, and $d_3$, has a value that is less than or about equal to the smaller of the first and second shoulder distances, $d_{s1}$ and $d_{s2}$.

Figure 10:
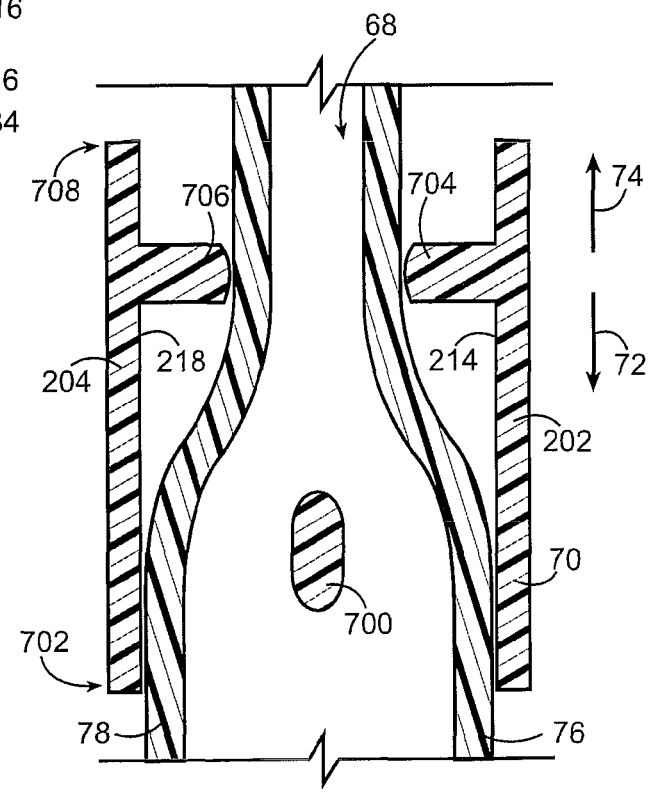
FIG. 10 is a cross-sectional view of the slider of FIG. 3 mounted on the closure elements of FIG. 2, taken generally along the lines 10-10 of FIG. 4, with portions behind the plane of the cross section omitted for clarity.

FIG. 10 illustrates the internal structure of a slider mounted on a slider actuated closure mechanism, for example, the slider 70 mounted on the slider actuated closure mechanism 68, as shown in FIG. 4. Referring now to FIGS. 3 and 10, a separation finger 700, shown in cross section in FIG. 10, vertically depends from the top wall 200 of the slider 70 between the first and second sidewalls 202, 204, and proximate to a first end 702 of the slider 70. First and second occlusion walls 704, 706 are disposed proximate to a second end 708 of the slider 708 and respectively extend form the first and second sidewalls 202, 204.

Referring now to FIGS. 4 and 10, the cross-sectional view in FIG. 10 is taken at a cross section between the first and fourth closure profiles 90, 122. FIG. 10 depicts a portion of the separation finger 700 that extends between the first and second closure elements 76, 78, and below the first closure profile 90, to deocclude at least the first and third closure profiles 90, 120. If the slider 70 was partially disengaged from the slider actuated closure mechanism 68, such as in a case described above where the total distance, $d_t$, is greater than the shorter of the first and second shoulders 206, 201, but less than the longer of the first and second shoulders 206, 201, the separation finger 700 may be upwardly displaced, and may not reach between the first and third closure profiles 90, 120 to facilitate deocclusion thereof. In FIG. 10, the first and second closure elements 76 and 78 are deoccluded at the first end 702 of the slider 70 and are occluded at the second end 708 of the slider 70.

Figure 11:
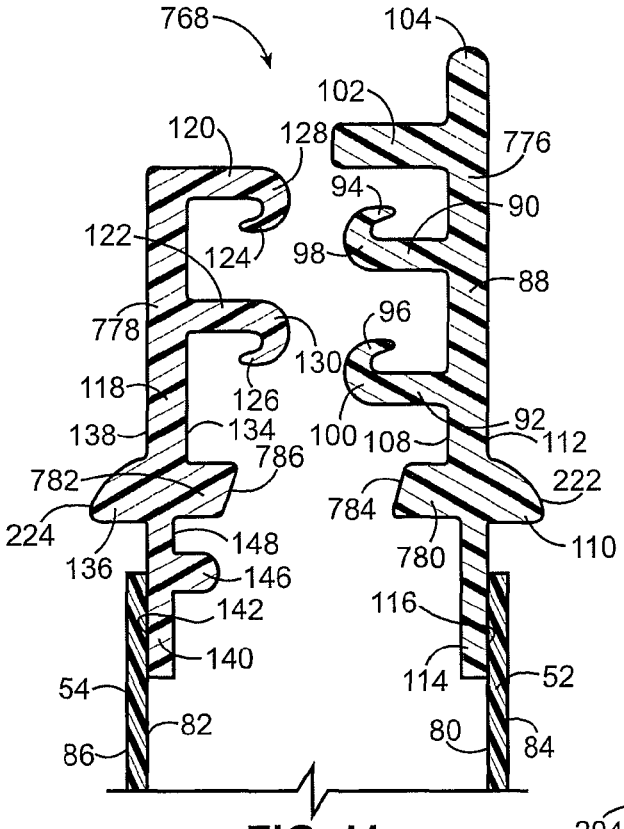
FIG. 11 is a cross-sectional view of another embodiment of closure elements of the slider actuated closure mechanism, taken generally along the lines 11-11 of FIG. 1, with portions behind the plane of the cross section omitted for clarity.
Figure 12:
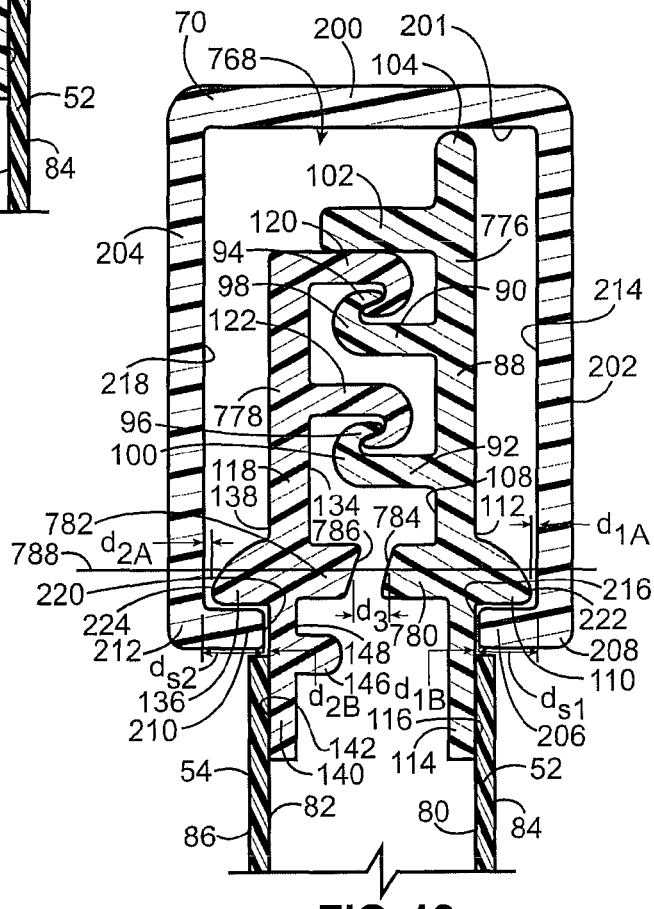
FIG. 12 is a cross-sectional view of the slider of FIG. 3 mounted on the closure elements of FIG. 11, taken generally along the lines 12-12 of FIG. 1, with portions behind the plane of the cross section omitted for clarity.

The first and second interior projections 106, 132 may be generally rectangular, as shown in FIGS. 2 and 4. However, it is also contemplated that the first and second interior projections 106, 132 may have any shape as desired or as may aid in the manufacture and/or utility thereof, for example, circular, elliptical, or wedge shaped. For example, another embodiment of a slider actuated closure mechanism 768, having first and second closure elements 776, 778, respectively including wedge shaped first and second interior projections 780, 782, is shown in FIGS. 11 and 12. In this embodiment, the third horizontal distance, $d_3$, is the smallest distance measured along a horizontal line, for example, the line 788, as shown in FIG. 12, between corresponding points of potential contact on the distal ends 784, 786 with the slider 70 mounted on the slider actuated closure mechanism 768. To inhibit disengagement of the slider 70 from the slider actuated closure mechanism 768 in this embodiment, the shorter of the first and second shoulder distances, $d_{s1}$ and $d_{s2}$, has a value greater than or about equal to the total distance, $d_t$, which is the sum of the first and second minimum horizontal distances, $d_1$ and $d_2$, and the third horizontal distance, $d_3$.

Figure 13:
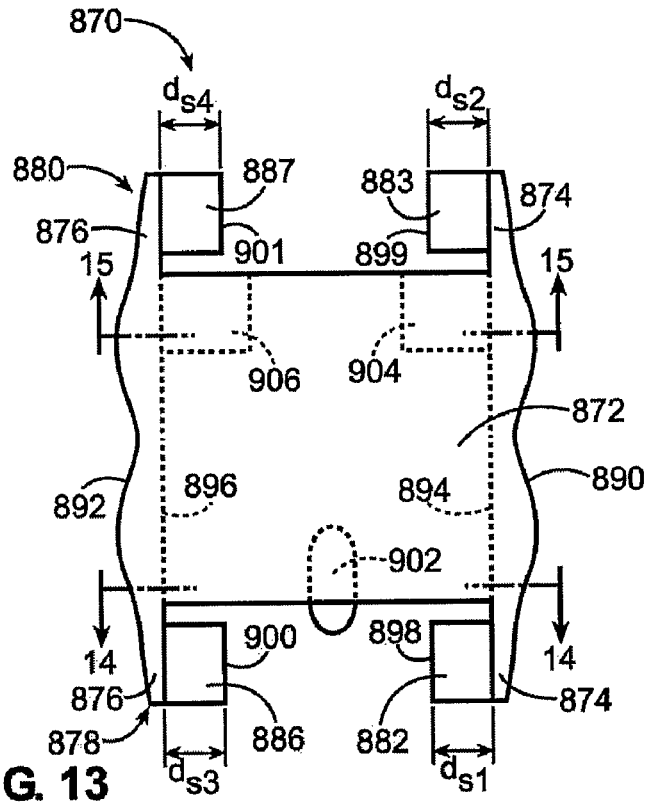
FIG. 13 is a top view of another embodiment of a slider.
Figure 14:
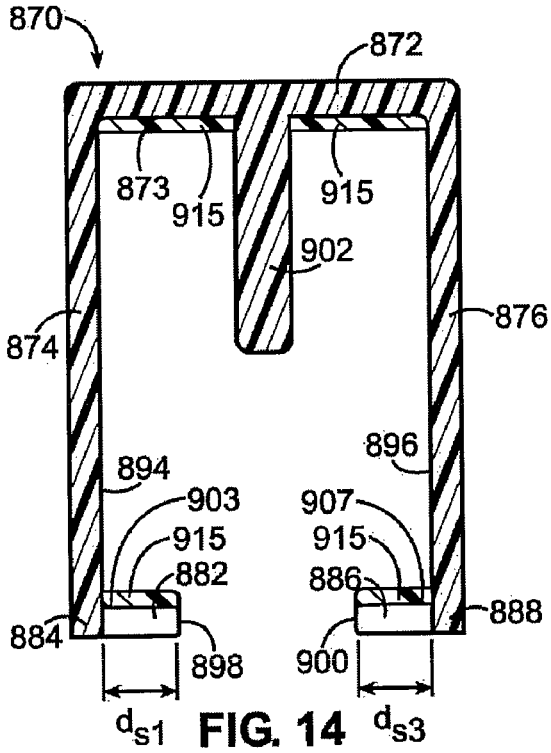
FIG. 14 is a cross-sectional view of the slider of FIG. 13, taken generally along the lines 14-14 of FIG. 13.
Figure 15:
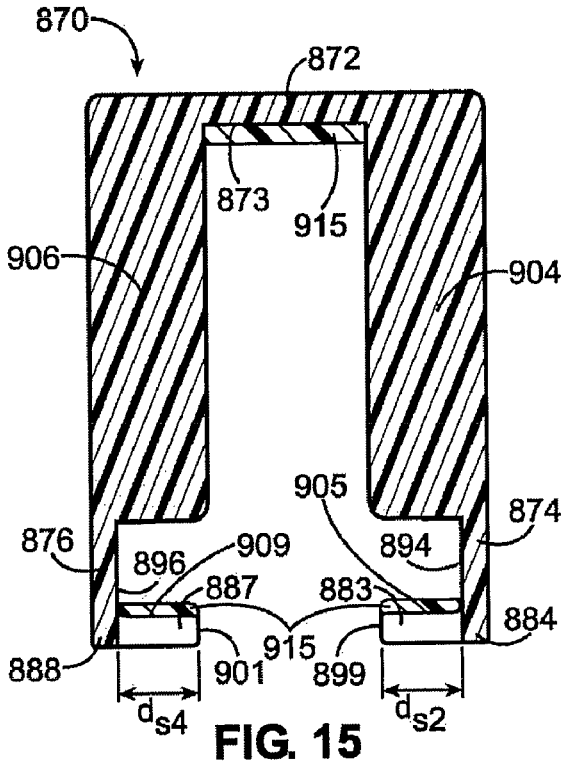
FIG. 15 is a cross-sectional view of the slider of FIG. 13, taken generally along the lines 15-15 of FIG. 13.

FIGS. 13-15 illustrate another embodiment of a slider 870 that may be used with a slider actuated closure mechanism, for example, the slider actuated closure mechanism 68 shown in FIG. 4. The slider 870 may have a centrally disposed top wall 872 and a slightly hourglass external shape that may assist a user in gripping the slider 870. FIG. 13 illustrates that each of the first and second sidewalls 874, 876 extends beyond the top wall 872 toward a first end 878 and a second end 880 of the slider 870. As can be seen in FIGS. 14 and 15, first and second sidewalls 874, 876 vertically depend from a top interior surface 873 of the top wall 872. A first shoulder 882 is disposed at a distal end 884 of the first sidewall 874 proximate to the first end 878 of the slider 870, and a second shoulder 883 is disposed at the distal end 884 of the first sidewall 874 proximate to the second end 880. The first shoulder 882 includes a first shoulder interior surface 903 and the second shoulder 883 includes a second shoulder interior surface 905. Similarly, a third shoulder 886 is disposed at a distal end 888 of the second sidewall 876 proximate to the first end 878 of the slider 870, and a fourth shoulder 887 is disposed at the distal end 88 of the second sidewall 876 proximate to the second end 880. The third shoulder 886 includes a third shoulder interior surface 907 and the fourth shoulder 887 includes a fourth shoulder interior surface 909.

Although exterior surfaces 890, 892 of the respective first and second sidewalls 874, 876 of the slider 870 may have an hourglass shape, in this embodiment, first and second interior surfaces 894, 896 of the respective first ands second sidewalls 874, 876, as illustrated in FIG. 13, are substantially flat. The first shoulder 882 extends a first shoulder distance, $d_{s1}$, measured from the first sidewall interior surface 894 to a distal end 898 of the first shoulder 882. The second should 883 extends a second shoulder distance, $d_{s2}$, measured from the first sidewall interior surface 894 to a distal end 899 of the second should 883. The third shoulder 886 extends a third shoulder distance, $d_o$, measured from the second sidewall interior surface 896 to a distal end 900 of the third shoulder 886. The fourth shoulder 887 extends a fourth shoulder distance, $d_{s4}$, measured from the second sidewall interior surface 896 to a distal end 901 of the fourth shoulder 882. FIG. 13 illustrates an embodiment in which the first and third shoulder distances, $d_{s1}$ and $d_{s3}$, are respectively equal in value to the second and fourth shoulder distances, $d_{s2}$ and $d_{s4}$.

In other embodiments (not shown), the first and second should distances, $d_{s1}$ and $d_{s2}$, may not be of equal lengths, the third and fourth shoulder distances, $d_{s3}$ and $d_{s4}$, may not be of equal lengths, and/or the first and second sidewall interior surfaces 894, 896 may not be substantially flat. In these embodiments, the smallest total distance, $d_t$, between the slider 70 and each of the first and second closure elements, for example, the first and second closure elements 76, 78 shown in FIG. 4, is similarly determined as described above by determining the corresponding values for each of the distances, $d_1$, $d_2$, and $d_3$. For example, when the first and second sidewall interior surfaces 894, 896 are concave between the first and second ends 878, 880 of the slider 870, the smallest total distance, $d_t$, may be determined at both of the first and second ends 878, 880. However, the smallest total distance, $d_t$, thus determined, may or may not have the same value at each of the first and second ends 878, 880, because of the concave geometry of the first and second sidewall interior surfaces 894, 896, and further, because each of the first, second, third, and fourth shoulder lengths $d_{s1}$, $d_{s2}$, $d_{s3}$, and $d_{s4}$ may have different values. For example, at the first end 878, the value of the smallest total distance, $d_t$, may be less than the smaller of the corresponding first and third shoulder distances, $d_{s1}$ and $d_{s3}$, while at the second end 880, the value of the smallest total distance, $d_t$, may be less than the smaller of the corresponding second and fourth shoulder distances, $d_{s2}$ and $d_{s4}$.

Referring now to FIGS. 4 and 14, a separation finger 902 may downwardly extend to a sufficient length when mounted on a slider actuated closure mechanism, for example, the slider actuated closure mechanism 68, to separate one or more pairs of corresponding interlocked closure profiles, for example, the first and second closure profiles 90, 92 from respective interlocking engagement with the third and fourth closure profiles 120, 122. Illustratively, the separation finger 902 may downwardly extend to just beyond the first closure mechanism 90 that is shown in FIGS. 4-9 and 12. As best seen in FIG. 15, first and second occlusion walls 904, 906 may have any desired vertical extent between the top wall 872 and an interior of the slider 870 that leaves enough clearance to accommodate the vertical extent of retention members, for example, the respective first and second retention members 110, 136 shown in FIG. 4.

In the manufacture of a pouch described herein, for example, in the embodiment of the pouch 50 shown in FIG. 1, the first and second pouch walls 52, 54 may be extruded as a single flat sheet that is folded over onto itself to form the bottom peripheral edge 58 for the pouch 50. The first and second closure elements, for example, 76 and 78 may each be extruded as a tape, independently from the first and second pouch walls 52, 54. The first and second flanges 114, 140 may be sealed to the interior surfaces 80, 82 of the respective first and second pouch walls 52, 54 by a heat seal or application of a thermoplastic weld layer, or by some other method as may be known to a person of skill in the art. A slider as herein described, for example, the slider 870 as shown in FIG. 13, may be injection molded as a single piece or molded or extruded as several pieces that are then affixed to one another by a method as may be known to a person of skill in the art. For example, in one embodiment, one or more of the interior surfaces 873, 894, 896, 903, 905, 907, and 909 may be manufactured of or may be coated with a material that has a low coefficient of friction to act as a lubricant, for example, a fluoropolymer material, such as a polytetrafluoroethylene, which is a TEFLON® coating. Each of the interior surfaces 873, 903, 905, 907, and 909 is illustrated in FIGS. 14 and/or 15 as optionally including a pad of material 915, for example, polytetrafluoroethylene, that has a low coefficient of friction with regard to the opposing surfaces of potential contact attached thereto.

Various details shown in FIGS. 1-15 may be modified as will be apparent to those of skill in the art without departing from the disclosed principles. Other methods and materials suitable for forming structures of the present invention may also be utilized.

INDUSTRIAL APPLICABILITY

A slider actuated closure mechanism that may be used on reclosable flexible pouches has been presented. A slider is retained on the slider actuated closure mechanism such that it slides away easily without requiring excessive application of force, but is also resistant to being transversely pulled off of the closure mechanism.

Numerous modifications to the present invention will be apparent to those skilled in the art in view of the foregoing description. Accordingly, this description is to be construed as being illustrative only, and is presented for the purpose of enabling those skilled in the art to make and to use the invention, and to teach the best mode of carrying out the same. The exclusive right to all modifications within the scope of the pending claims is expressly reserved. All patents, patent publications and applications, and other references cited herein are incorporated by reference herein in their entirety.

We claim:

1. A closure mechanism comprising:

a first closure element including (i) a first base, (ii) a first interlocking member projecting inwardly from an internal side of the first base, (iii) a projection that extends from the internal side of the first base, (iv) a retention member that extends opposite to the first projection from an external side of the first base, and (v) a first sealing flange that extends downwardly from the first base below the first projection;

a second closure element including (i) a second base, (ii) a second interlocking member projecting inwardly from an internal side of the second base in opposing relation to the first interlocking member, and (iii) a second sealing flange that extends downwardly from the second base; and a slider disposed over the first and second closure elements for occluding and deoccluding the first and second closure elements, the slider including (i) first and second sidewalls depending downwardly from a top wall, and (ii) a shoulder extending inwardly from a distal end of the first sidewall and disposed below the retention member, wherein a first horizontal distance $d_1$ is the smallest horizontally measured distance between the slider and the first closure element, a second horizontal distance $d_2$ is the smallest horizontally measured distance between the slider and the second closure element, a third horizontal distance $d_3$ is a horizontally measured distance between the projection and the second closure element when the first and second interlocking members are in an interlocked state, and the sum of the distances $d_1$, $d_2$, and $d_3$ equals a total non-zero distance $d_t$ that is less than a length that the shoulder inwardly extends from the first sidewall, so as to inhibit the slider from disengaging from the first and second closure elements.

2. The closure mechanism of claim 1, wherein the projection is a first projection, and the closure mechanism further comprises a second projection that extends from an internal side of the second base above the second sealing flange such that the third horizontal distance $d_3$ is a horizontally measured distance between the first projection and the second projection.

3. The closure mechanism of claim 2, wherein the shoulder is a first shoulder, and the closure mechanism further comprises a second shoulder extending inwardly from a distal end of the second sidewall a length that is greater than $d_t$.

4. The closure mechanism of claim 3, further comprising a material reservoir protrusion disposed on at least one of the first and second projections.

5. The closure mechanism of claim 4, wherein the material reservoir protrusion is made of a material that has a lower melting temperature than adjacent portions of the first and second projections.

6. The closure mechanism of claim 4, wherein portions of each of the first and second shoulders are coated with polytetrafluoroethylene.

7. A closure mechanism comprising:

a first closure element having a first interlocking member that extends from an interior side of a first base thereof;

a second closure element having a second interlocking member that extends from an interior side of a second base thereof and in an occluded state releasably interlocks with the first interlocking member;

a projection that extends from the interior side of the first base spaced from the first interlocking member on a product side thereof;

a first retention member that extends directly opposite to the projection from an exterior side of the first base;

a second retention member that extends from an exterior side of the second base;

a first sealing flange that extends downwardly from the first base below the first retention member;

a second sealing flange that extends downwardly from the second base below the second retention member;

a slider mounted over the first and second closure elements, the slider including (i) a first sidewall vertically depending from a top wall, the first sidewall having a first shoulder inwardly extending from a distal end thereof and horizontally past a distal end of the first retention member, and (ii) a second sidewall vertically depending from the top wall, the second sidewall having a second shoulder inwardly extending from a distal end thereof and horizontally past a distal end of the second retention member; and an upward extension extending vertically from the first base, wherein the upward extension in conjunction with the first retention member limits the vertical range of motion of the slider, wherein the first sidewall and a portion of the first closure element are minimally horizontally separated by a distance $d_1$, the slider and a portion of the second closure element are minimally horizontally separated by a distance $d_2$, the distal end of the first projection and the second closure element are horizontally separated by a distance $d_3$ when the first and second interlocking members are in the occluded state, and the sum of the distances $d_1$, $d_2$, and $d_3$ equals a total distance, $d_1$, that is less than a length that a shorter of the first and second shoulders horizontally extends from the respective first and second sidewalls to inhibit the slider from disengaging from the first and second closure elements.

8. The closure mechanism of claim 7, wherein the projection is a first projection, and the closure mechanism further comprises a second projection that extends from the interior side of the second base spaced from the second interlocking member on a product side thereof and directly opposite to the first projection such that the third horizontal distance $d_3$ is a horizontally measured distance between an end portion of the first projection and an end portion of the second projection.

9. The closure mechanism of claim 8, wherein the first and second projections are each wedge shaped such that the third horizontal distance $d_3$ is a horizontally measured distance between corresponding points of potential contact on the end portions of the first and second projections.

10. The closure mechanism of claim 8, wherein the first and second projections are vertically offset from the respective first and second retention members.

11. The closure mechanism of claim 7, wherein at least a portion of an interior surface of the top wall is coated with polytetrafluoroethylene.

12. The closure mechanism of claim 8, wherein each of the first and second sidewalls extends beyond the top wall toward a first end and a second end of the slider.

13. The closure mechanism of claim 12, wherein the first shoulder is disposed at the distal end of the first sidewall proximate to the first end of the slider, the second shoulder is disposed at the distal end of the second sidewall proximate to the first end of the slider, a third shoulder is disposed at a distal end of the first sidewall proximate to the second end of the slider, and a fourth shoulder is disposed at the distal end of the second sidewall proximate to the second end of the slider, and wherein each of the first and second shoulders inwardly extends from the respective first and second sidewalls a length that is greater than $d_t$ as determined proximate to the first end of the slider, and each of the third and fourth shoulders inwardly extends from the respective first and second sidewalls a length that is greater than $d_t$ as determined proximate to the second end of the slider.

14. The closure mechanism of claim 13, wherein portions of each of the first, second, third, and fourth shoulders are coated with polytetrafluoroethylene.

15. The closure mechanism of claim 14, wherein interior surfaces of the first and second sidewalls are substantially flat, and exterior surfaces of the first and second sidewalls have a longitudinally oriented hourglass shape.

16. A closure mechanism comprising:

a first closure element including (i) first and second hooked closure profiles extending from an internal side of a first base thereof, (ii) a first projection having an end portion that extends from the internal side of the first base and spaced from the first and second closure profiles on a product side thereof, (iii) a first sealing flange that downwardly extends from the first base below the first projection, and (iv) a retention member that extends opposite to the first projection from an external side of the first base;

a second closure element including (i) third and fourth hooked closure profiles that extend from an internal side of a second base thereof and in an occluded state releasably interlock with the first and second closure profiles, respectively, (ii) a second projection having an end portion that extends from the internal side of the second base and spaced from the third and fourth closure profiles on a product side thereof and directly opposite to the first projection, and (iii) a second sealing flange that downwardly extends from the second base below the second projection;

a slider disposed over the first and second bases and including (i) a first side wall vertically depending from a top wall, the first side wall having a first shoulder extending from a distal end thereof, and (ii) a second side wall vertically depending from the top wall, the second side wall having a second shoulder extending from a distal end thereof; and an upward extension extending vertically from the first base, wherein the upward extension in conjunction with the first retention member limits the vertical range of motion of the slider, wherein, a first horizontal distance $d_1$ is the smallest horizontally measured distance between the slider and the first closure element, a second horizontal distance $d_2$ is the smallest horizontally measured distance between the slider and the second closure element, a third horizontal distance $d_3$ is a horizontally measured distance between the end portions of the first and second projections, and the sum of the distances $d_1$, $d_2$, and $d_3$ equals a total non-zero distance $d_t$ that is less than a length that each of the first and second shoulders inwardly extends from the respective first and second sidewalls to prevent the slider from disengaging from the first and second closure elements.

17. The closure mechanism of claim 16, wherein each of the first and second bases increases in cross-sectional thickness from a thinner top end to a thicker bottom end.

18. The closure mechanism of claim 16, further comprising a material reservoir protrusion disposed on an interior surface of at least one of the first and second sealing flanges.

19. The closure mechanism of claim 16, wherein at least a portion of an interior surface of the slider is coated with polytetrafluoroethylene.

* * * * *